US008662305B2

(12) United States Patent
Sung

(10) Patent No.: US 8,662,305 B2
(45) Date of Patent: Mar. 4, 2014

(54) ARTIFICIAL NAIL DISPLAY PACKAGE

(75) Inventor: Siyong Sung, Roslyn Heights, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 188 days.

(21) Appl. No.: 13/111,659

(22) Filed: May 19, 2011

(65) Prior Publication Data

US 2011/0303235 A1 Dec. 15, 2011

Related U.S. Application Data

(63) Continuation-in-part of application No. 12/797,325, filed on Jun. 9, 2010, now Pat. No. 8,245,849.

(51) Int. Cl.
*B65D 83/04* (2006.01)

(52) U.S. Cl.
USPC ..... 206/535; 206/457; 206/499

(58) Field of Classification Search
USPC ..... 206/216, 223, 528, 526, 581, 499, 457, 206/535; 215/6; 220/23.86, 23.83, 4.26
See application file for complete search history.

(56) References Cited

U.S. PATENT DOCUMENTS

| | | | | |
|---|---|---|---|---|
| 1,999,328 | A | 4/1935 | Lessard | |
| 2,575,770 | A | 11/1951 | Roop | |
| 3,362,530 | A | 1/1968 | Neil | |
| 3,595,417 | A * | 7/1971 | Musher | 215/222 |
| 3,732,999 | A * | 5/1973 | Rounkles | 215/6 |
| 3,927,783 | A * | 12/1975 | Bogert | 215/222 |
| D287,578 | S | 1/1987 | Shay et al. | |
| D307,196 | S | 4/1990 | McClure | |
| 5,050,757 | A * | 9/1991 | Hidding et al. | 220/23.83 |
| D358,546 | S * | 5/1995 | Walchek et al. | D3/203.3 |
| 5,816,408 | A | 10/1998 | Indelicato | |
| 6,036,018 | A | 3/2000 | Harrold | |
| D460,354 | S | 7/2002 | Goldiner et al. | |
| 6,997,321 | B2 | 2/2006 | Young | |
| 7,628,278 | B2 | 12/2009 | Coppola | |
| 8,033,409 | B2 * | 10/2011 | Lindemann | 220/4.21 |
| 2004/0045867 | A1 | 3/2004 | Appelbaum | |
| 2004/0226904 | A1 * | 11/2004 | Schroeder | 215/6 |
| 2005/0000850 | A1 | 1/2005 | Young | |
| 2005/0006267 | A1 | 1/2005 | Lam et al. | |
| 2005/0051454 | A1 * | 3/2005 | Coe et al. | 206/536 |

(Continued)

FOREIGN PATENT DOCUMENTS

| | | |
|---|---|---|
| DE | 42 06 244 | 9/1993 |
| EP | 1 523 903 | 4/2005 |
| FR | 2 620 913 | 3/1989 |
| GB | 1 016 015 | 1/1996 |

*Primary Examiner* — David Fidei
(74) *Attorney, Agent, or Firm* — The Farrell Law Firm, P.C.

(57) ABSTRACT

A display package is provided that informs the customer of the product contained therein as well as providing a functional and useful storage unit for artificial nails when not in use. The display package includes a cylindrical neck portion at a first end having one or more grooves and a cap having one or more tabs located in an inner portion of the cap, the one or more tabs fitting into the one or more grooves. The display package further comprises a main body having a front wall, a back wall, and sidewalls that contour inwards to connect to the cylindrical neck portion, the main body having a flat base at a second end opposite to the cylindrical neck portion with the walls of the main body forming a cavity there within.

10 Claims, 11 Drawing Sheets

(56) References Cited

U.S. PATENT DOCUMENTS

2006/0157375 A1 7/2006 DeJonge
2007/0045148 A1 3/2007 Saclier et al.
2008/0060957 A1 3/2008 Ford et al.
2008/0073237 A1 3/2008 Jackson
2008/0237082 A1 10/2008 Ghardan et al.

* cited by examiner

ARTIFICIAL NAIL DISPLAY PACKAGE

PRIORITY

This application is a Continuation-In-Part Application of application Ser. No. 12/797,325, filed Jun. 9, 2010, and claims priority under 35 U.S.C. §119(a) to U.S. Application No. 29/363,448, the contents of which are incorporated herein by reference.

BACKGROUND OF THE INVENTION

1. Field of the Invention

The present invention relates generally to a display package, and more particularly to a display package shaped as a nail polish bottle for displaying artificial nails.

2. Description of the Related Art

An industry has grown around pre-formed artificial nails to provide people with the appearance of well-manicured hands while offering the convenience of a disposable and easy to maintain product. Caring for and growing nails naturally can be both costly and time consuming; thus fashion-conscious customers often choose artificial nails.

Artificial nails are generally packaged in a generic-looking cardboard and/or plastic display package. Typically square or rectangular in shape, common displays for artificial nails do not inform the customer as to the items contained within and are simply a way for a product to be delivered to the consumer. In general, these display packages are functionally unsatisfactory in that they must be torn open and do not easily re-seal, if at all. The desired artificial nails are removed and any extras are often impossible to store in the torn package for later use. This is not a secure method of storage and a user may become frustrated by having loose artificial nails fall out of the display package, and which may easily become lost.

Additionally, such display packages do not offer much in the way of marketing appeal. A more effective display package would allow a customer, from a distance, to recognize the product contained therein. In a marketing sense, a rectangular or square shaped box is not very appealing for a fashionable person shopping for a fashionable item.

For example, in Coppola (U.S. Pat. No. 7,628,278), a packaging arrangement for artificial nails is described. The packaging of Coppola is intended to educate customers as to the curvature of their nail and guide them in choosing the appropriate product. However, the packaging does not hold the artificial nails in a readily accessible and convenient way. Additionally, the shape of the packaging does not provide instantaneous recognition by the customer of the product contained within.

Accordingly, in the field of artificial nails, a display package is needed that informs the customer of the product contained therein as well as providing a functional and useful storage unit for artificial nails when not in use.

SUMMARY OF THE INVENTION

The present invention has been made to address at least the above problems and/or disadvantages and to provide at least the advantages described below. Accordingly, an aspect of the present invention provides a display package for artificial nails generally shaped as a nail polish bottle.

According to one embodiment of the present invention, an artificial nail display package is in the shape of a package of nail polish. The display package includes a cylindrical neck portion at a first end having one or more grooves and a cap having one or more tabs located in an inner portion of the cap, the one or more tabs fitting into the one or more grooves. The display package further comprises a main body having a front wall, a back wall, and sidewalls that contour inwards to connect to the cylindrical neck portion, the main body having a flat base at a second end opposite to the cylindrical neck portion with the walls of the main body forming a cavity there within.

According to a further embodiment of the present invention, a method of packaging and displaying artificial nails comprises forming a first portion and a second portion to divide a main body and a cylindrical neck portion and joining the first portion and the second portion to form a display package. The method further comprises fitting a cap over a cylindrical neck portion of the display package, the cap having one or more tabs located in an inner portion of the cap and twisting the cap over the cylindrical neck portion and the cylindrical neck portion having one or more grooves, the one or more tabs fitting into the one or more grooves.

According to an additional embodiment of the present invention, an apparatus for packaging and displaying artificial nails comprises a package body having a first half and a second half, the first half being symmetrical to the second half and a cap having one or more tabs located in an inner portion of the cap. The apparatus further comprises an internal cavity formed within the package body when the first half is connected to the second half, wherein the package body comprises a cylindrical neck portion at a first end having one or more grooves, the one or more tabs fitting into the one or more grooves, a front wall, a back wall, side walls that contour inwards to connect to the cylindrical neck portion, and a flat base at an end opposite to the cylindrical neck portion.

BRIEF DESCRIPTIONS OF THE DRAWINGS

The above and other aspects, features and advantages of the present invention will be more apparent from the following description when taken in conjunction with the accompanying drawings, in which.

Figure 3A:
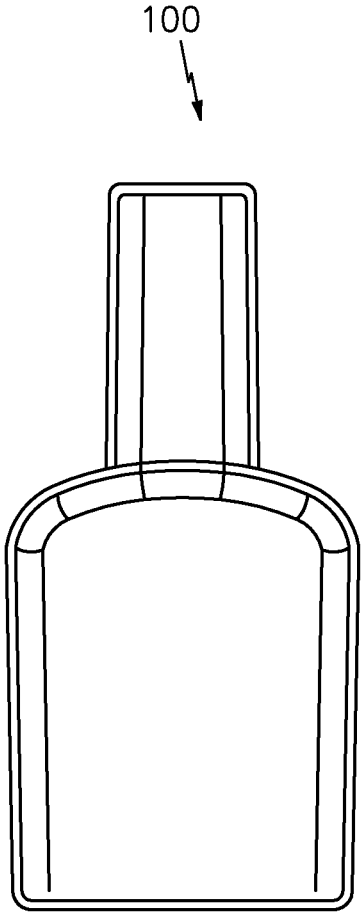
Figure 3B:
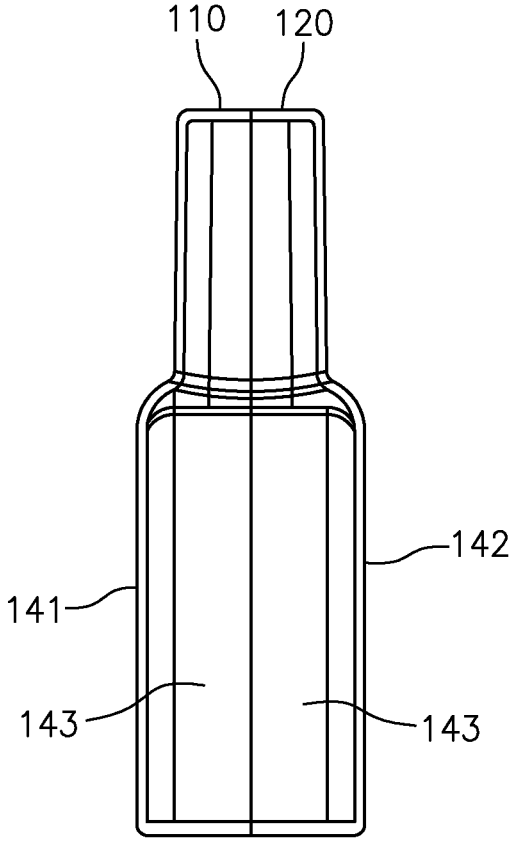
Figure 4:
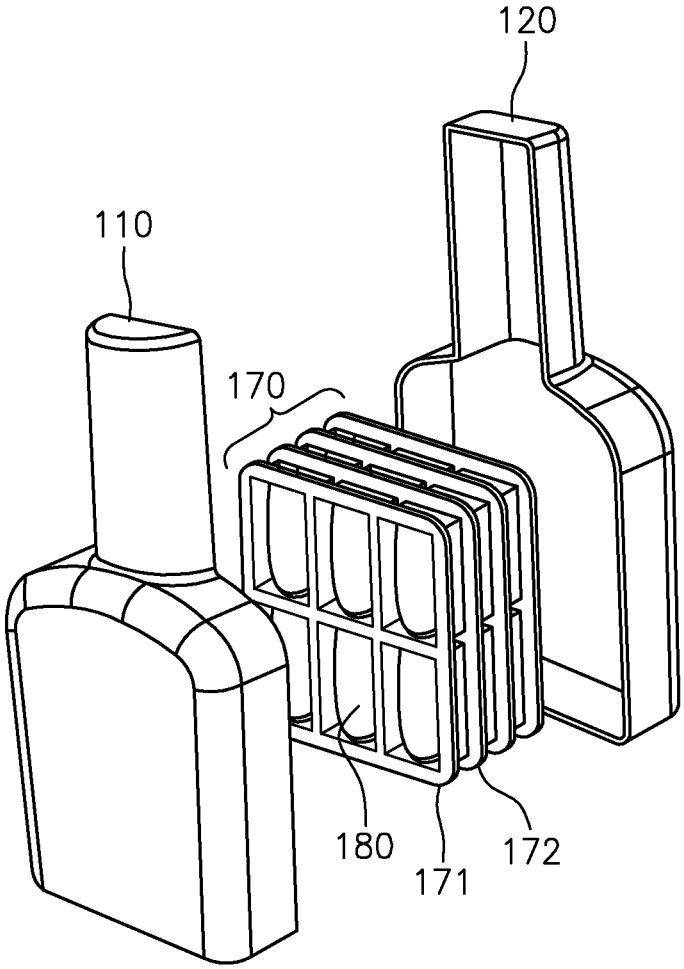
Figure 5A:
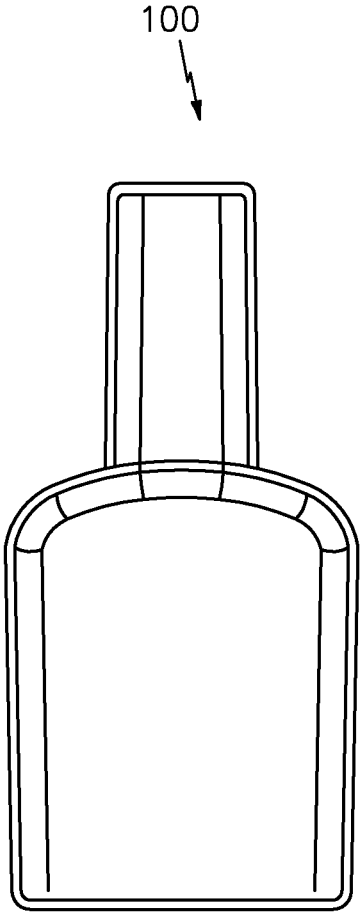
Figure 5B:
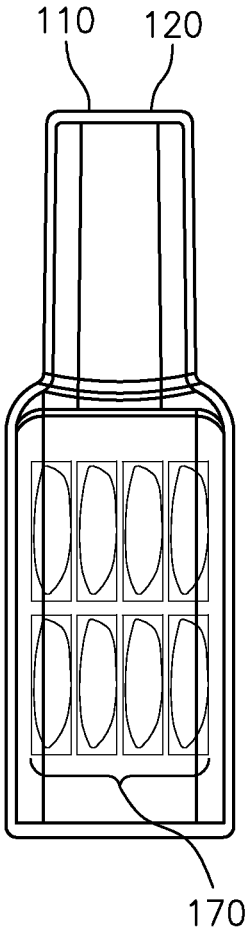
Figure 6:
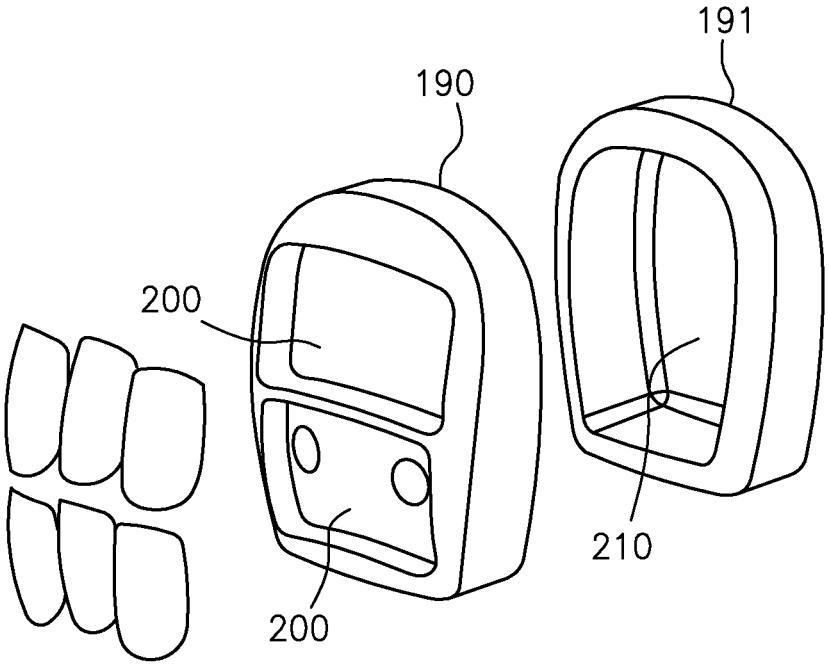
Figure 7:
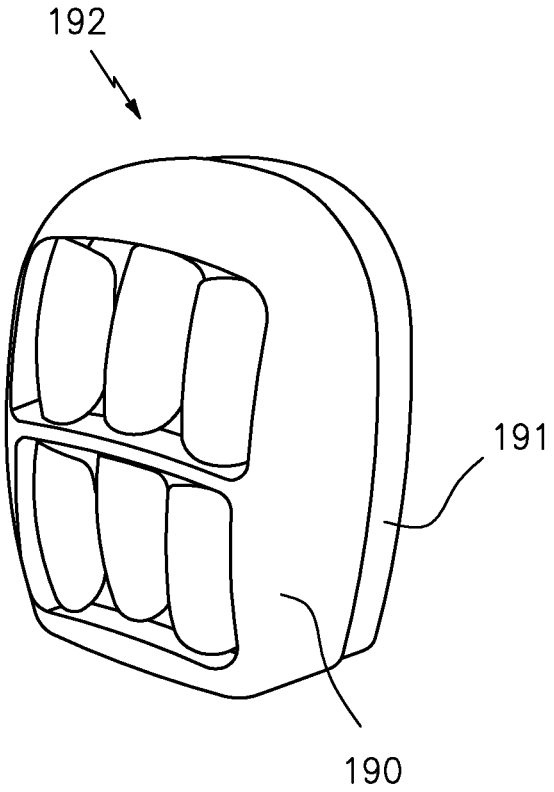
Figure 8:
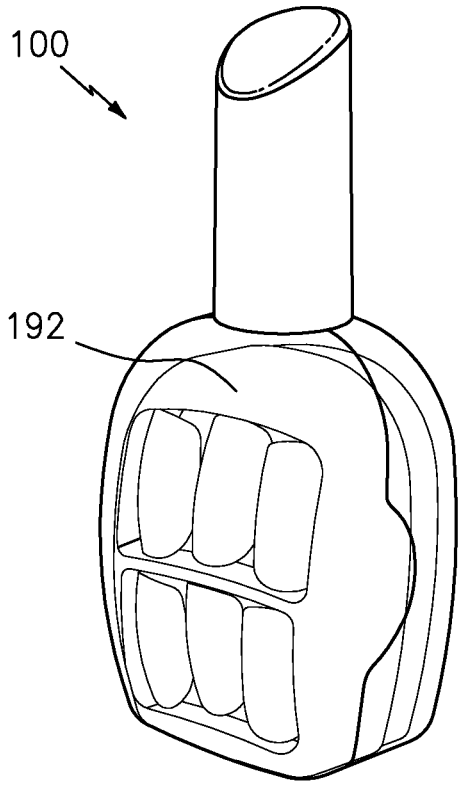
Figure 9:
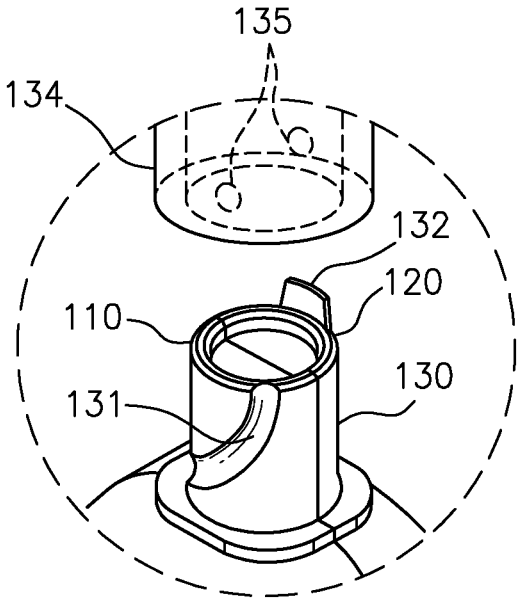
Figure 10:
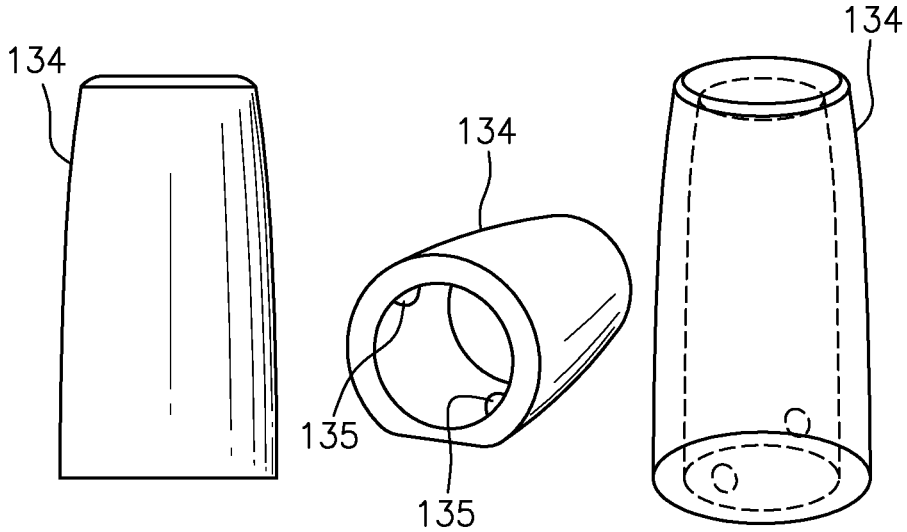
Figure 11A:
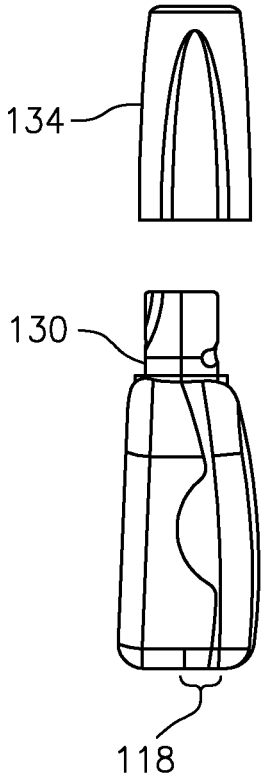
Figure 11B:
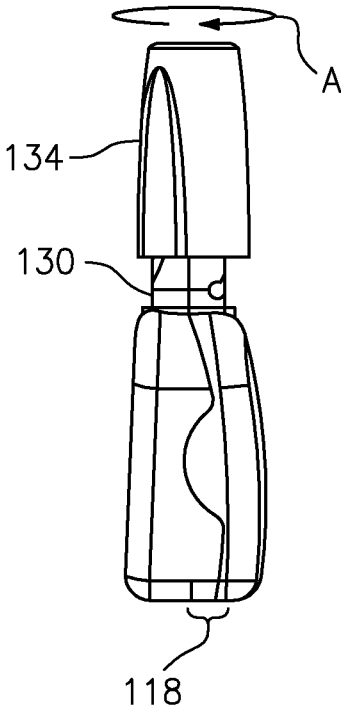
Figure 11C:
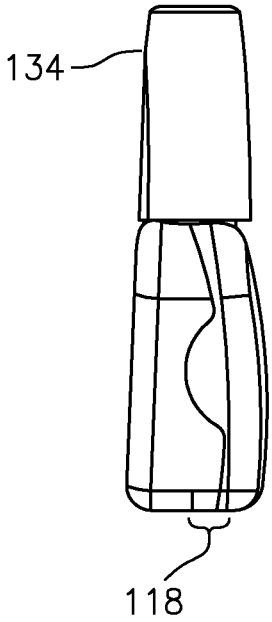
Figure 12:
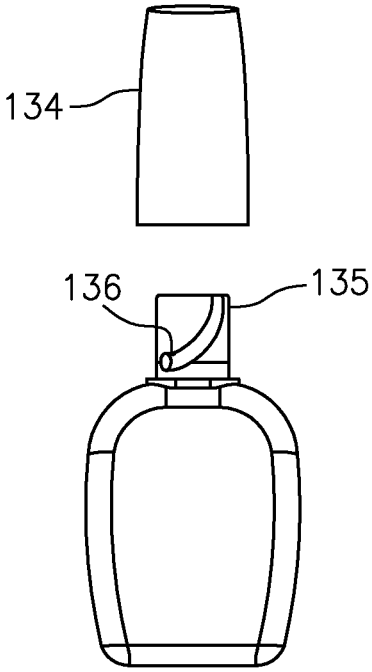

FIGS. 3(*a*) and 3(*b*) illustrate a front-view and a side-view of the display package;

FIG. 4 illustrates an exploded perspective view of the display package including a plurality of trays for supporting artificial nails, according to an embodiment of the present invention;

FIGS. 5(*a*) and 5(*b*) illustrate an assembled front-view and side-view including the plurality of trays;

FIG. 6 illustrates an exploded view of a tray case, according to a further embodiment of the present invention;

FIG. 7 illustrates the tray case assembly;

FIG. 8 illustrates the tray case within the display package;

FIG. 9 illustrates a further embodiment of the invention including cylindrical neck portion having one or more grooves and a pull-tab;

FIG. 10 illustrates a cap having one or more detents or tabs located in an inner portion of the cap;

FIGS. 11(*a*)-11(*c*) illustrate the cap twisting around the cylindrical neck portion;

FIG. 12 illustrates the tabs passing over locking bumps; and

Figure 13:
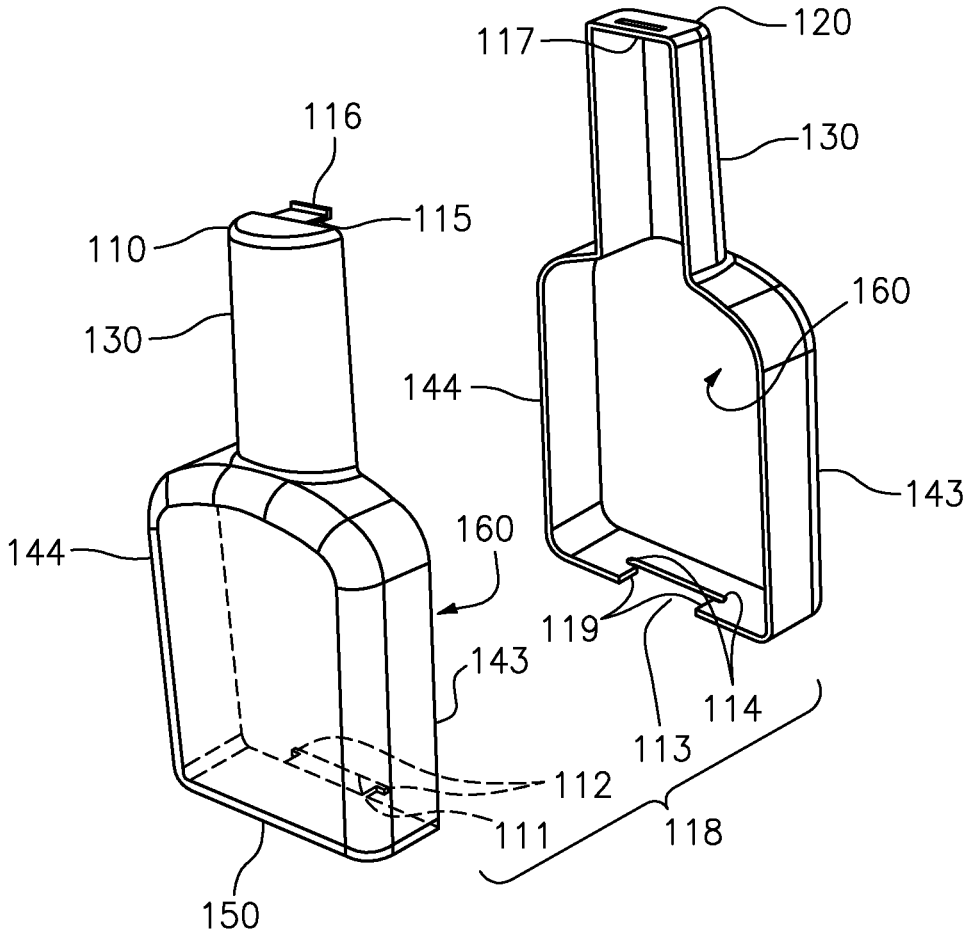

FIG. 13 illustrates a hinge connecting the first portion and the second portion.

DETAILED DESCRIPTION OF EMBODIMENTS OF THE PRESENT INVENTION

Embodiments of the present invention are described in detail with reference to the accompanying drawings. The same or similar components may be designated by the same or similar reference numerals although they are illustrated in different drawings. Detailed descriptions of constructions or processes known in the art may be omitted to avoid obscuring the subject matter of the present invention.

The terms and words used in the following description and claims are not limited to their dictionary meanings, but are merely used to enable a clear and consistent understanding of the invention. Accordingly, it should be apparent to those skilled in the art that the following description of embodiments of the present invention are provided for illustrative purposes only and not for the purpose of limiting the invention, as defined by the appended claims and their equivalents.

Figure 1:
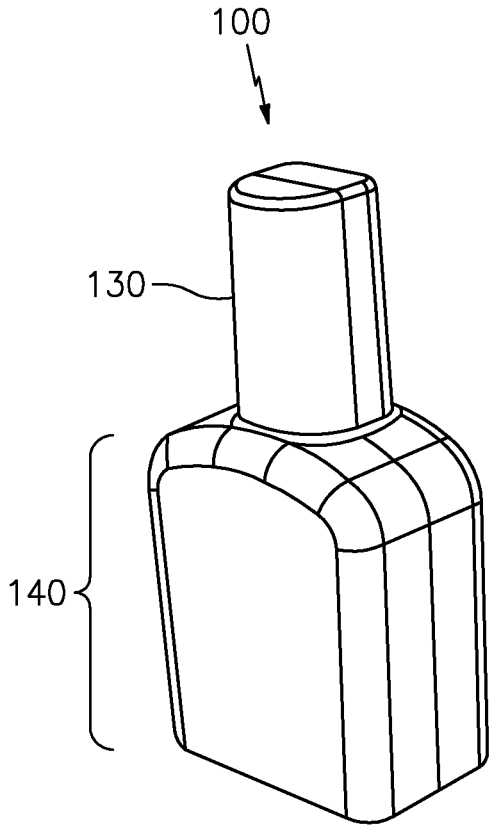
FIG. 1 illustrates a perspective view of a display package for artificial nails, according to an embodiment of the present invention.
Figure 2:
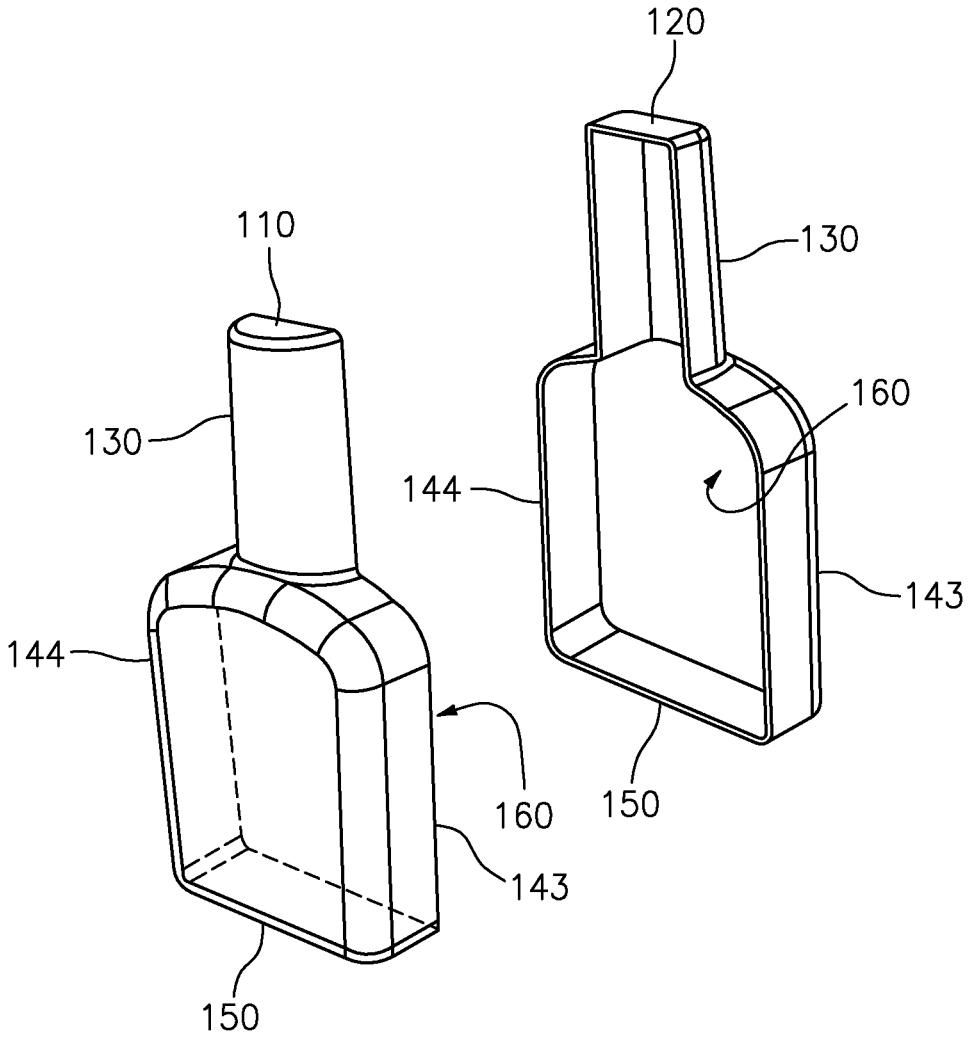
FIG. 2 illustrates an exploded view of the display package.

FIGS. 1 and 2 illustrate a display package 100, according to an embodiment of the present invention. The display package 100 includes a first portion 110 and a second portion 120, which, when attached, form the shape of a nail polish bottle. The display package is preferably a clear plastic made through a vacuum formed or injection-molded process. In the current embodiment, the first portion 110 and second portion 120, divide the display package 100 vertically in half. However, the display package 100 could be divided in many different ways, such as for example, horizontally. A cylindrical neck portion 130 extends from a main body 140. The main body 140 has a flat bottom portion 150 that allows the display package 100 to remain upright when placed on a flat surface. When the first portion 110 and the second portion 120 are brought together an empty cavity 160 is formed within the main body 140 of the display package 100

FIG. 3 illustrates a front-view (a) and a side-view (b) of a display package 100, according to an embodiment of the present invention. In side-view 3(*b*), the first portion 110 and the second portion 120 are shown affixed together to form display package 100. The empty cavity 160 is formed within the main body 140 of the display package 100. The main body 140 includes a front wall 141, a back wall 142, and side-walls 143 and 144 that contour inwards to connect to the cylindrical neck portion 130 at one end of the display package 100 and meet at the top end opposite to the flat bottom portion 150.

FIG. 4 illustrates an exploded perspective view of the display package 100 including one or more trays 170, according to an embodiment of the present invention. The trays 170 can be made of various plastics by a vacuum formed or injection molded process. The trays 170 have a plurality of indentations 180 for holding items such as artificial nails. The plurality of indentations 180 can be aligned in a grid pattern or various other patterns and are shaped such that when a first tray 171 is stacked on a second tray 172, the first 171 and the second tray 172 may join in an interlocking manner.

As shown in FIG. 5, when the first portion 110 and the second portion 120 are joined together to form display package 100, the trays 170 are located within the empty cavity 160 of the display package 100. The first portion 110 and the second portion 120 may join by a snap fit, interlocking tabs or any other manner known by those of ordinary skill in the art. The trays 170 preferably have a similar shape as the main body 140 to prevent the trays 170 from moving within the empty cavity 160.

FIG. 6 illustrates a further embodiment of the invention having a cover tray 190 including indentations 200 for holding items such as artificial nails. The cover tray 190 fits over a bottom tray 191 to form a tray case 192, shown in FIG. 7. The tray case 192 fits within the empty cavity 160 (not shown) of display package 100, as illustrated in FIG. 8. When the cover tray 190 and bottom tray 191 are attached, a hollow space 210 is created for holding items such as artificial nails. Indentations 200 hold items such as artificial nails in an upright and organized position, whereas hollow space 210 holds items such as artificial nails in a loose manner.

FIG. 9 illustrates a further embodiment of the invention including cylindrical neck portion 130 having one or more grooves 131 and a pull-tab 132 for separating the first portion 110 from the second portion 120. The pull-tab 132 may extend from either the cylindrical neck portion 130 of the first portion 110 or the second portion 120. FIGS. 9 and 10 illustrate a cap 134 having one or more detents or tabs 135 located in an inner portion of the cap 134. The tabs 135 fit into the one or more grooves 131, and travel in the grooves 131 upon rotation of the cap 134 to secure the cap in place over the cylindrical neck portion 130, thus locking the first portion 110 and the second portion 120 together.

As illustrated in FIGS. 11(*a*)-11(*c*), the cap 134 is positioned over the cylindrical neck portion 130 and, as the tabs 135 are guided by the grooves 131, the cap 134 is twisted around the cylindrical neck portion 130, completing, approximately, a one-quarter turn following the motion indicated by arrow A. FIG. 12 illustrates the tabs 135 passing locking bumps 136 located near the end of the grooves 131, which occurs just before the cap 134 is in the fully locked position. The locking bumps 136 extend from the edge of the grooves 131 and allow the tabs 135 to lock into place at the end of the grooves 131, thus securing the cap 134.

FIG. 13 illustrates a further embodiment of the invention having a hinge 118 connecting the first portion 110 and the second portion 120, including an first hinge portion 111 extending from the first portion 110 having insertion tabs 112 to be inserted into receiving holes 114 of a second hinge portion 113. The second hinge portion 113 includes one or more half-round insert grooves 119, which allow the insertion tabs 112 to be inserted into the receiving holes 114. FIG. 13 further illustrates a locking mechanism for the display package 100. Specifically, the first portion includes a tab 115 extending from the first portion 110 having a locking ridge 116, which fits into a locking groove 117 positioned under the top of the second portion 120. Accordingly, when the first portion 110 and the second portion 120 are pushed together, the locking ridge 116 snaps into the locking groove 117, securing the first portion 110 and the second portion 120.

While the invention has been shown and described with reference to certain embodiments thereof, it will be understood by those skilled in the art that various changes in form and detail may be made therein without departing from the spirit and scope of the invention as defined by the appended claims and their equivalents.

What is claimed is:

1. A display package comprising:

a cylindrical neck portion at a first end;

a main body having a front wall, a back wall, and side walls that contour inwards to connect to the cylindrical neck portion, the main body having a flat base at a second end opposite to the cylindrical neck portion, and the front wall, the back wall, and the sidewalls of the main body forming a cavity there within; and at least one tray disposed within the cavity having a plurality of open indentations for receiving items.

2. The display package of claim 1, wherein the main body is separable into a first portion and a second portion to divide the main body and the cylindrical neck portion to allow access to the cavity, and are joined together to form the display package.

3. The display package of claim 2, further comprising a hinge connecting the first portion and the second portion of the main body, the hinge comprising:

a first hinge portion extending from the first portion of the main body and having insertion tabs to be inserted through one or more insert grooves into receiving holes of a second hinge portion, the second hinge portion disposed on the second portion of the main body.

4. The display package of claim 3, further comprising a pull-tab extending from the first end, to facilitate separating the first portion of the main body from the second portion of the main body.

5. The display package of claim 2, further comprising:

a locking mechanism including a tab extending from the first portion having a locking ridge, which fits into a locking groove positioned under the top of the second portion, wherein the locking ridge snaps into the locking groove, securing the first portion and the second portion when the first portion and the second portion are pushed together.

6. The display package of claim 3, wherein the display package is in the shape of a nail polish bottle when the first portion of the main body is joined to the second portion of the main body.

7. The display package of claim 1, wherein the display package is formed from a clear plastic.

8. The display package of claim 1, wherein the at least one tray comprises:

a cover tray; and a bottom tray, wherein when the cover tray and the bottom tray are attached, a tray case is formed and a hollow space for holding items is formed within the tray case.

9. The display package of claim 8, wherein the cover tray comprises the plurality of open indentations aligned in a grid pattern on an exterior of the tray case.

10. The display package of claim 1 further comprising a cap having one or more tabs disposed in an inner portion of the cap, wherein the cylindrical neck portion comprises one or more grooves into which the one or more tabs fit.

* * * * *